United States Patent [19]

Rodriguez

[11] Patent Number: 4,588,048

[45] Date of Patent: May 13, 1986

[54] FOUR POST LIFT AND TRACK ADJUSTING MEANS THEREFOR

[75] Inventor: Saulo V. Rodriguez, McAllen, Tex.

[73] Assignee: Economove Corporation, McAllen, Tex.

[21] Appl. No.: 590,988

[22] Filed: Mar. 19, 1984

[51] Int. Cl.[4] ..... B605 13/00

[52] U.S. Cl. ..... 187/8.67; 254/2 B

[58] Field of Search ..... 187/8.67, 8.59, 8.5, 187/8.41, 19, 9 R, 8.43; 74/422, 89.17; 248/429, 424; 254/2 R, 2 B, 2 C, 6 R, 6 B, 6 C, 95, 96; 414/678

[56] References Cited

U.S. PATENT DOCUMENTS

| | | | |
|---|---|---|---|
| 206,993 | 10/1854 | Armentrout | 187/19 |
| 1,700,308 | 1/1929 | Chilson et al. | 248/429 |
| 2,168,624 | 8/1939 | Musgrave | 187/8.67 |
| 2,956,645 | 10/1960 | Halstead | 187/8.67 |
| 4,134,501 | 1/1979 | Tune | 187/8.43 |
| 4,269,285 | 5/1981 | Ohkoshi et al. | 187/9 R |

FOREIGN PATENT DOCUMENTS

| | | | |
|---|---|---|---|
| 3001298 | 7/1981 | Fed. Rep. of Germany | 187/19 |
| 534578 | 3/1941 | United Kingdom . | |

*Primary Examiner*—Joseph J. Rolla
*Assistant Examiner*—Kenneth Noland
*Attorney, Agent, or Firm*—G. Turner Moller

[57] ABSTRACT

A four post lift provides first and second pairs of vertical supports. A pair of beams or rails extend between the supports and are simultaneously raised and lowered for elevating an automobile supported on a pair of tracks spanning the beams or rails. The tracks are movable toward and away from each other to accommodate vehicles of different width. There are provided devices for moving one of the rails relative to the other. The moving devices comprises a rack on each of the rails, a pair of pinions carried by the rails in engagement with the racks, devices interconnecting the pinions for simultaneous movement and devices for rotating the pinions.

14 Claims, 6 Drawing Figures

FIG. 1
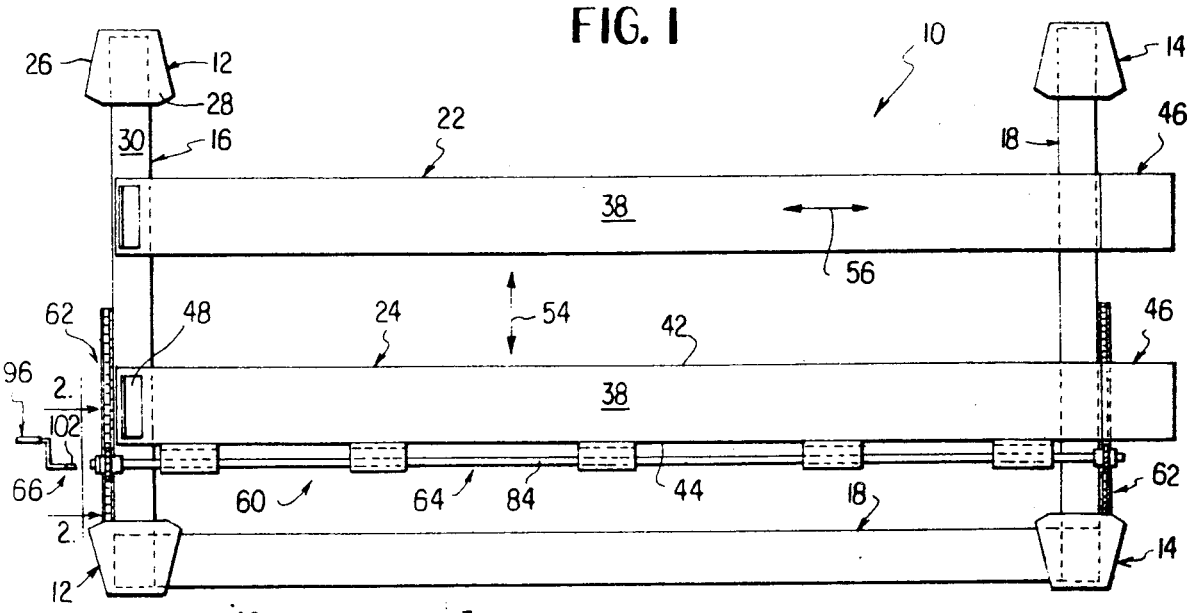
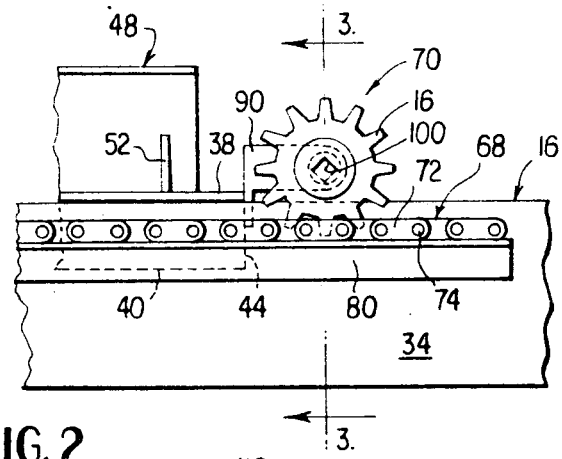
FIG. 2
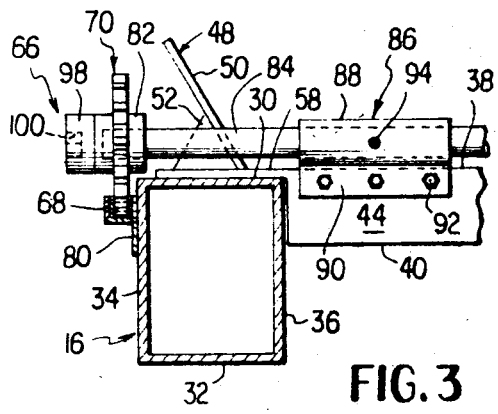
FIG. 3
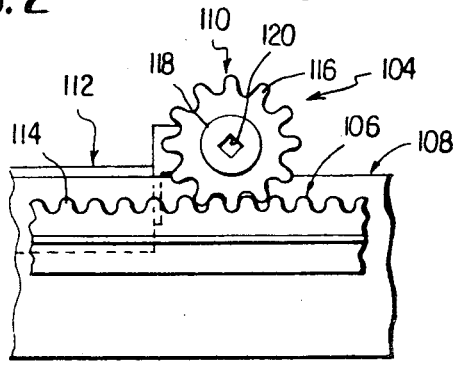
FIG. 4
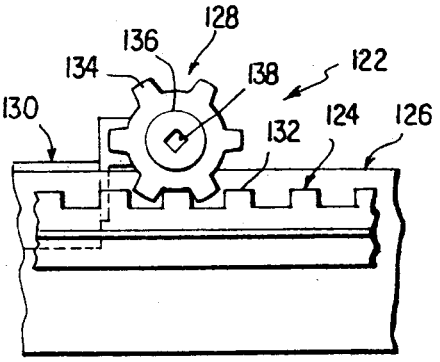
FIG. 5
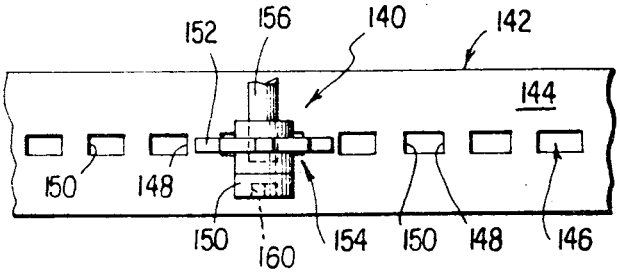
FIG. 6

FOUR POST LIFT AND TRACK ADJUSTING MEANS THEREFOR

This invention relates to vehicle lifts, by which is meant mechanisms for raising and lowering a vehicle from an underlying ground surface so that a workman or mechanic has easy access to the underside of the vehicle.

Lifts of this type include hydraulically operated mechanisms having a central vertical support which carries a frame having a pair of tracks thereon for supporting the vehicle. In this type device, the tracks are movable toward and away from each other to accommodate vehicles of different width.

Another type of lift commonly used in the industry is called a four post lift since four vertical supports are provided, one at each corner of a rectangle. A pair of beams or rails extend between the posts along the short side of the rectangle and carry a pair of tracks which support the vehicle. Means are provided for simultaneously raising and lowering the beams or rails relative to the posts in order to raise and lower the vehicle. The rails or mounted for sliding movement toward and away from each other in order to accommodate vehicles of varying width.

The size and weight of the vehicle supporting tracks vary somewhat, depending on the capacity of the lift, whether the lift is of the single post or four post variety, and the exact design thereof. In some situations, the tracks can weigh as much as 1500 pounds apiece, presenting some considerable difficulty in adjusting the tracks to accommodate vehicles of different width. The difficulty in moving one of the tracks is compounded by the length thereof and the slidable mounting means by which the track is mounted onto the rails. It will be appreciated that the mounting mechanism is typically a simple- metal-to-metal contact without the provision of bearings or rollers which might facilitate sliding movement of the track. Similarily, because of the length of the track, it is sometimes easy to get the track askew and jammed between the rails thereby assuring no further movement of the track.

In response to these and other difficulties, there have been suggestions in the prior art to provide means for moving the tracks of a vehicle lift in order to facilitate gauge or width adjustment thereof, as shown in exemplary U.S. Pat. Nos. 2,956,645 and 4,134,501 along with Great Britain Patent No. 534,578. Whatever the merits of these devices, it is evident that they have not commanded respect in the market place since none are commercially available. It appears, from first inspection, that these devices are entirely too complicated and consequently entirely too expensive to withstand the necessary markups that are necessary to manufacture and distribute a track adjusting mechanism for a vehicle lift.

In summary, this invention comprises a vehicle lift and track adjusting means therefor in which the track adjusting means comprises a rotary-to-linear motion converter in which one component thereof is carried by each of the rails. Another component of the converter is carried by the track to be moved. Means interconnect the components carried by the tracks to assure simultaneous movement of the converter. Means are also provided for rotating the rotary component of the converter thereby to linearly move the track toward and away from its adjacent track.

In preferred embodiments of this invention, the rotary-to-linear motion converter comprises a rack affixed to or part of each of the beams. A pinion is carried by the track to be moved and a shaft interconnects both pinions. The pinions and/or shaft are operatively connected to the track to be moved. A polygonal drive, such as a square opening in the end of the pinion, is provided. The workman or mechanic who desires to move the track merely inserts a breaker arm of a socket set into the polygonal drive opening and rotates the pinion with the breaker arm. This causes both pinions to rotate in the same direction thereby sliding the track toward or away from its adjacent track as caused by the interaction between the rack and pinion.

The configuration of the rack and pinion may vary widely. In a perferred embodiment of the invention, intended to be installed on existing lifts, the rack comprises a chain which has been secured to a bracket. In another preferred embodiment of the invention, intended to be incorporated in lifts during the manufacture thereof, the rack comprises a series of openings which have been punched into the body of the beam or rail.

It is accordingly an object of this invention to provide an improved lift and track adjusting mechanism therefor which is characterized by simplicity of design and manufacture as well as foolproof operation.

Other objects and advantages of this invention will become more fully apparent as this description proceeds, reference being made to the accompanying drawings and appended claims.

IN THE DRAWINGS

FIG. 1 is a top plan view of a four post lift equipped with a track adjusting mechanism in accordance with the principles of this invention;

FIG. 2 is an enlarged partial end view, taken substantially along line 2—2 thereof as viewed in the direction indicated by the arrows;

FIG. 3 is a longitudinal cross-sectional view of the mechanism of FIGS. 1 and 2 taken substantially along line 3—3 thereof as viewed in the direction indicated by the arrows;

FIG. 4 is a view similar to FIG. 2 illustrating another embodiment of this invention;

FIG. 5 is a view similar to FIGS. 2 and 4 illustrating a further embodiment of this invention; and FIG. 6 is a top plan view of another embodiment of this invention.

Referring to FIG. 1, there is illustrated a vehicle lift 10 which is of the four post type comprising, as major components, a plurality of spaced pairs of verticals supports 12, 14, a pair of beams or rails 16, 18 spanning between the supports 12, 14, means 20 for simultaneously raising and lowering the rails 16, 18 and a pair of vehicle supporting tracks 22, 24 spanning between the rails 16, 18.

The supports 12, 14 are conveniently substantially identical and comprise a generally C-shaped channel 26 having upper and lower end plates 28. The beams 16, 18 are received in the open end of the C-shaped channel 26 and are supported therefrom by any suitable mechanism, which is typically a cable arrangement (not shown).

The rails 16, 18 are conveniently box shaped channels having pulleys and the like therein for accommodating the cables used to raise and lower the rails 16, 18. The rail 16 comprises a top wall 30, a bottom wall 32, a front or side wall 34 and a back or side wall 36.

The raising and lowering means 20 may be of any suitable description and typically comprises a hydraulic cylinder (not shown) having an output end connected to the cable arrangement running through the beams 16, 18 and connected to the supports 12, 14.

The vehicle supporting tracks 22, 24 are typically identical and comprise a shallow box-shaped structure having an upper fraction surface 38 on which the vehicle drives, a lower surface 40 and sidewalls 42, 44 completing the box structure. A pair of ramps 46 are connected to the tracks 22, 24 and are downwardly inclined to allow the vehicle to cross over the top of the rail 18. A bumper or restraint 48 is disposed at the forward end of the lift 10 to prevent the vehicle from driving over the end of the tracks 22, 24. The restraint or bumper 48 may be of any suitable type but is typically an inclined plate 50 which is affixed, as by welding or the like, to a pair of spaced gussets 52 which are affixed to the forward end of the upper track wall 38.

As shown best in FIG. 3, the tracks 22, 24 are mounted for lateral movement along the beams 16, 18 in a direction indicated by the arrow 54 which is perpendicular to the direction of vehicle movement indicated by the arrow 56. To this end, the forward most end of the tracks 22, 24 comprise a planar extension 58 to which is secured the bumper or restraint 48. As shown best in FIG. 3, the extension 58 forms a notch with the remainder of the track 24 at a location to receive the upper end of the beam 16. The ends of the tracks 22, 24 overlying the beams 18 define a similar slideable connection. It will accordingly be seen that the tracks 22, 24 may be moved laterally of the direction of vehicle movement indicated by the arrow 54 in order to accommodate vehicles of different gauge or width.

Those skilled in the art will recognize the lift 10 as being of the four post type manufactured by Grand, Inc., 1400 East Berry, Fort Worth, Texas 76119. A more complete description of this type lift is shown in publications of Grand, Inc. to which reference is made.

In order to adjust the spacing between the tracks 22, 24, it is not necessary to move both tracks 22, 24. It will suffice, of course, to move only one of the tracks to thereby adjust for the width or gauge of vehicles elevated by the lift 10.

To this end, means 60 of this invention are provided to move the track 24 relative to the track 22. The moving means 60 of this invention comprises a pair of rotary-to-linear motion converters 62, means 64 interconnecting the converters 62 to assure simultaneous movement thereof and means 66 for energizing the converters 62.

The rotary-to-linear motion converters may be of any suitable type. Preferably, the converters 62 are characterized by simplicity of design, manufacture and operation, sturdiness and foolproof operation. To this end, the motion converter 62 comprises a rack 68 comprising the linear component of the motion converter 62 and a pinion 70 meshing with the rack 68 and comprising the rotary component of the motion converter 62. The linear component or rack 68 is affixed to each of the beams 16, 18 in any suitable manner. The pinion 70 or rotary component of the motion converter 62 is carried by the track 24 so that rotation of the pinion 70 causes the pinion 70 and track 24 to walk along the rack 68 in a direction depending on the direction of rotation of the pinion 70.

In the embodiment of FIGS. 1-3, the rack 68 preferably comprises a length of chain comprising a multiplicity of links 72 which are interconnected by pins 74 in a conventional manner. It will be evident that the pinion 70 comprises a gear wheel providing a multiplicity of teeth 76 each of which passes sequentially into the gap between adjacent pins 70 and pushes thereagainst during rotation of the pinion 70. The chain or rack 68 is conveniently welded inside an upwardly facing channel 78 having a depending leg 80 affixed to the front wall 34 of the beam 16 in any suitable fashion as by welding or the like.

As shown best in FIGS. 2 and 3, the pinion 70 comprises a hub 82 which is connected, at one end thereof, to the interconnecting means 64. The interconnecting means 64 conveniently comprises a shaft 84 running substantially the length of the track 24 and spans the distance between the beams 16, 18. The function of the shaft 84 is to assure that the pinions 70 at opposite ends of the track 24 rotate simultaneously in order to move the track 24 parallel to the arrow 54 without canting or skewing the track 24. The shaft 84 is mounted on the edge of the track 24 by a plurality of bearing or bushing assemblies 86 which typically comprise a length of conduit 88 having an arm 90 attached thereto which is secured to the sidewall 44 of the track 24 in any conventional manner, as by the provision of threaded fasteners 92. A grease fitting 94 is desirably provided in the conduit 88 to allow lubrication of the bushing assembly 86.

The driving means 66 comprises a polygonal drive allowing the use of a breaker arm from a socket set or a crank 96 to rotate the pinion 70 thereby to laterally move the track 24 in the direction indicated by the arrow 54. To this end, the driving means 66 conveniently comprises a circular extension 98 on the end of the hub 82 providing a polygonal or square opening 100 therein to receive the square or polygonal end 102 of the crank 96. Although the polygonal drive afforded by the driving means 66 is illustrated as a polygonal opening, it will be equally apparent that the drive may comprise a polygonal stud onto which a wrench fits. It will be seen that the axis of the polygonal opening is coincident with the axis of the shaft 84.

Referring to FIG. 4, there is illustrated a track moving means 104 having a rack 106 mounted on a rail 108 and a pinion 110 mounted on a track 112. It will be seen that the rack 106 comprises a multiplicity of conventional smoothly arcuate gear teeth 114 which mesh with similarly shaped teeth 116 of the pinion 104. The pinion 104 includes an extension 118 having a polygonal opening 120 therein comprising the drive mechanism for rotating the pinion 110 and thereby moving the track 112 in an adjusting direction. It will be understood, of course, that the track moving means 104 comprises a similar rack and pinion mechanism on the other beam (not shown) and a mechanism for assuring simultaneous rotation of both pinions.

Referring to FIG. 5, there is illustrated a track moving mechanism 122 comprising another embodiment of this invention including a rack 124 mounted on a rail 126 and a pinion 128 mounted on a track 130. It will be seen that the rack 126 includes a multiplicity of generally square or rectilinear teeth 132. The rack 124 is accordingly of the type which may be stamped from a piece of stock material. The pinion 128 includes a multiplicity of generally trapezoidal teeth 134 which means, of course, that the pinion 128 may also be stamped rather than machined. The pinion 128 includes an extension 136 having a polygonal opening 138 therein comprising the drive mechanism for rotating the pinion 128 and thereby moving the track 130 in an adjusting direction. As in the embodiment of FIG. 4, it will be understood that a similar rack and pinion mechanism exists on the opposite beam of the lift with means being provided to assure simultaneous operation of both rack and pinion mechanism.

Referring to FIG. 6, there is illustrated a track moving mechanism 140 which is particularly designed to be incorporated in lifts during the manufacture thereof. In the embodiment of FIG. 6, a beam 142 spans between the supports of the lift. The beam 142 includes an upper or top wall 144 which has been passed through a punch to form openings 146 therein in an aligned fashion. The openings 146 provide shoulders 148, 150 which are capable of reacting against the teeth 152 of a pinion 154 carried on a shaft 156 which is affixed to the vehicle supporting track (not shown) in any suitable manner. The pinion 154 includes an extension 158 having a polygonal drive therein comprising a polygonal opening 160. In the embodiment of FIG. 6, it will be seen that the rack against which the pinion 154 reacts is built into the beam 142 rather than being added thereto. Consequently, it is believed that the embodiment of FIG. 6 lends itself best to incorporation in a lift during the manufacture thereof.

Although the invention has been described in its preferred forms with a certain degree of particularity, it is understood that the present disclosure is only by way of example and that numerous changes in the details of construction and in the combination and arrangement of parts may be resorted to without departing from the spirit and scope of the invention as hereinafter claimed.

I claim:

1. In a vehicle lift of the type having vertical support means comprising first and second pairs of vertical supports, first and second beams extending between the first and second pairs of supports, first and second vehicle supporting tracks mounted on the first and second beams, means for simultaneously raising and lowering the beams relative to an underlying ground surface, means mounting the tracks for movement toward and away from each other to accommodate vehicles of different width, the mounting means allowing skewing movement between the track, the improvement comprising means for constraining the first track for linear movement toward and away from the second track and for moving the first track linearly toward the second track including a rack carried by each of the first and second beams and a pair of pinions carried by the first track in meshing engagement with the racks;

a shaft interconnecting the pinions for simultaneous rotation; and means for rotating the pinions.

2. The lift of claim 1 wherein the linear component comprises a rack affixed to each beam and a pinion in engagement with each rack, and the interconnecting means comprises a shaft interconnecting the pinions.

3. The lift of claim 1 further comprising means connecting the shaft to the first track comprising bearings receiving the shaft.

4. The lift of claim 1 wherein the rack comprises a chain having a multiplicity of links and means affixing the chain to the beam and the pinion comprises a gear wheel meshing with the links of the chain.

5. The lift of claim 1 wherein the rack comprises a rigid piece of metal providing a multiplicity of smooth gear teeth thereon and the pinion comprises a gear wheel having a multiplicity of smooth gear teeth thereon meshing with the rack.

6. The lift of claim 1 wherein the rack comprises a rigid piece of metal providing a multiplicity of square shoulders thereon and the pinion comprises a gear wheel having a multiplicity of trapezoidal gear teeth thereon meshing with the shoulders.

7. The lift of claim 1 wherein the beams provide a series of aligned openings therein providing a multiplicity of shoulders, the multiplicity of shoulders comprising the rack, and the pinion comprises a gear wheel meshing with the shoulders.

8. The lift of claim 1 wherein the rotating means comprises a polygonal drive carried by the pinion.

9. The lift of claim 8 wherein the polygonal drive comprises a polygonal opening in the pinion.

10. The lift of claim 9 wherein the polygonal opening defines an axis parallel to the axis of the shaft.

11. The lift of claim 10 wherein the opening axis is parallel to the shaft axis.

12. The lift of claim 1 wherein the vertical support means comprises first and second pairs of vertical supports and the first and second beams extend between the first and second pairs of supports, and the means for raising and lowering the beams comprise means carried by the vertical supports for moving the beams relative to the supports.

13. The device of claim 1 wherein the shaft is parallel to the first track and further comprising at least one bearing, connected to the first rack at each end thereof, rotatably receiving the shaft and at least one additional bearing, connected to the first track intermediate the end bearings, receiving the shaft.

14. The device of claim 1 wherein the linear moving means is free of additional guides for guiding the first track relative to the second track, linear movement of the first track being effected by simultaneous rotation of the pinions.

* * * * *